United States Patent [19]

Johnston et al.

[11] 4,384,606

[45] May 24, 1983

[54] ENVIRONMENTAL STRIP CURTAIN

[75] Inventors: Calvin H. Johnston, Los Angeles; Jack Oxman, Newport Beach, both of Calif.

[73] Assignee: Johnston Environmental Corporation, Santa Ana, Calif.

[21] Appl. No.: 182,469

[22] Filed: Aug. 28, 1980

Related U.S. Application Data

[63] Continuation of Ser. No. 28,229, Apr. 9, 1979, abandoned.

[51] Int. Cl.[3] ..... E06B 9/20

[52] U.S. Cl. ..... 160/332; 160/184

[58] Field of Search ..... 160/184, 332

[56] References Cited

U.S. PATENT DOCUMENTS

| | | | |
|---|---|---|---|
| 3,331,425 | 7/1967 | Groves et al. | 160/184 |
| 4,095,642 | 6/1977 | McKinnon et al. | 160/332 |
| 4,165,778 | 8/1979 | Smith | 160/332 |

*Primary Examiner*—Peter M. Caun

*Attorney, Agent, or Firm*—Edward J. DaRin

[57] ABSTRACT

An environmental curtain constructed of flexible, transparent plastic strips suspended in an opening to function as a thermal barrier. The plastic strips are arranged in a partially overlapping relationship. Each strip is defined with one end having each corner cut out to an extent for producing a central solid portion. The solid central portion of the strip may be provided with a row of spaced apertures arranged adjacent one end of the strip. An inner row of spaced apertures are arranged in vertical alignment with the outer row to permit a temporary suspension loop for the strip to be defined when the inner and outer rows of apertures are aligned in overlying relationship and secured together. The strips may include side flaps adjacent the central loop that extends below the strip suspension means and allow the relative position of the adjacent strips to be changed while still suspended by the suspension means.

19 Claims, 8 Drawing Figures

ENVIRONMENTAL STRIP CURTAIN

CROSS REFERENCE TO RELATED APPLICATIONS

This is a continuation of Ser. No. 28,229, filed Apr. 9, 1979, abandoned.

PRIOR ART AND SUMMARY OF THE INVENTION

This invention relates to environmental strip curtains and more particularly to an improved apparatus and method for suspending flexible, plastic strips comprising the environmental curtain.

Flexible, transparent plastic strips have been used for providing a thermal barrier between the opposite sides of an opening such as a door or the like. The plastic strips are suspended adjacent the top of an opening to the bottom of an opening to function as a thermal barrier between the opposite sides of the opening to eliminate the need of a solid door that must be opened for ingress and egress. The plastic strips are conventionally constructed and defined to be suspended in a vertical, partially overlapping relationship which permits an individual to readily part the strips by hand to move through the strips and the opening. After an individual has walked through the plastic strips, they automatically assume their closed, vertical relationship. The plastic strips are also manufactured with sufficient structural rigidity to permit carts, dollies, fork lift trucks and similar conveyances to be moved or driven through the plastic strips without damage to the strips or degradation of the thermal barrier.

Environmental strip curtains have been found to be very advantageous to control dust and smoke, maintain stable temperatures, reduce product spoilage, lessen sound levels, restrict drafts, insects, sparks, and flying chips, cut cooling and heating maintenance and to generally save up to 50% in energy requirements. These environmental curtains have been found to increase productivity in food processing and other temperature controlled plants, laboratories, warehouses, refrigerated trucks, hospitals, clean rooms, computer installations and other interior and exterior applications where environmental isolation is necessary or desirable.

The plastic strips have heretofore been mounted in different modes. The early designs of the strip curtains suspended the strips in an overlapping relationship between two bars and then the assembled bars and strips were secured to the openings by fasteners. In addition to the difficulty in the initial installation of this prior art type of suspension arrangement required that part or all of the entire assembly be taken down to replace a damaged strips or strips. This prior art type of suspension arrangement usually required 2 men, 1 to 3 hours to complete an installation. More recent designs have provided the strips with a suspension loop permanently formed on one end of the strips by folding the end upon itself and heat bonding the edge of the strip to create the permanent loop thereon. This type of loop design was considered advantageous since it allowed one end of the mounting bar to be attached to an opening and the looped strips to be slipped over the bar. To replace a damaged strip, however, the mounting bar must be released and the damaged strip located and removed and then replaced. One such prior art construction wherein the strips have a permanent loop defined thereon is disclosed in U.S. Pat. No. 4,095,642. In this type of prior art construction, also, normally two people are required to install the curtains. One person is required to hold the suspension bar and the other person to retrieve and slide on the looped strips onto the suspension bar. Ease of installation and cost of installation are very important factors in the decision to acquire environmental strip curtains. To this end such curtains are installed in openings that may rise as high as 20 feet above the ground level. Installation in such openings would require ladders and/or scaffolding. When an opening on the order of 20 feet is desired, the 20 foot long plastic strips are very heavy and difficult to handle. Accordingly, ease of installation for such applications is a very critical factor. Accordingly, at the present tme, there is still a need for improved environmental curtains that may be readily and inexpensively installed.

The present invention provides an improved and relatively inexpensive construction of the plastic strips comprising an environmental strip curtain and an improved method for suspending and installing the strips. The plastic strips of the present invention are advantageously defined to permit a temporary suspension loop to be defined during the installation procedures for the curtain that can be accomplished by one person. The plastic strip is constructed and defined to allow the end of the loop to be placed under the suspension bar or rod and then looped over the bar and securing the thus defined loop temporarily by means of a suitable fastener, all accomplished by one person. Similarly, on replacement of a damaged strip of the type of the present invention, the fastener can be readily released to open up the loop and thereby permit the strip to be removed from the suspension bar after the bar or rod is loosened. A new strip can be mounted to replace the damaged strip in a very short time when this procedure is followed. No tools need be required for the installation as the fasteners may be secured by hand. The improved strip is defined with a substantially central suspension loop that allows the user to change the relative positions of the adjacent strips while still in a suspended condition and alternate them at different times of the year in accordance with the weather conditions prevailing. The width of the central suspension loop can be varied to vary the amount of overlap between the strips.

From a structural standpoint, the present invention provides a flexible, transparent strip for use in combination with other similar transparent strips as an environmental curtain. The strip has a pre-selected length and a slight longitudinal concavity. The strips are constructed of a flexible plastic material of sufficient weight and thickness to be suspended in a vertical relationship with an opening it is hung to so as to function as a thermal barrier between the opposite sides of the opening. One end of the strip is constructed and defined with each corner cut out to an extent defining a solid portion substantially centrally of the longitudinal edges of the strip and extending from said one end. The central portion of the strips adjacent the cut out corners are defined to permit them to be looped onto the strip proper to define a suspension loop when temporarily secured in the looped position. The strip may include means for temporarily securing the looped central portion to the strip proper for defining a strip suspension loop. The securing means is preferably a plastic fastener that is compatible with the plastic employed for the strip proper.

From a method standpoint, the present invention provided a method of suspending an environmental curtain, including the steps of providing a plurality of flexible, transparent strips adapted to be mounted in an opening to function as a thermal barrier between opposite sides of the opening. Cutting out each corner of each strip at one end thereof a pre-selected distance inwardly of the one end a sufficient distance to permit the remaining central portion of the strip to be folded upon itself to form a supporting loop. Loosely mounting a curtain supporting structure at said opening. Mounting one of the thus defined strips on the curtain supporting structure for the opening by looping the thus defined central portion over and around the supporting structure. Releasably securing the looped portion to the strip proper to thereby suspend the strip from the supporting structure. Repeating the latter two steps for each of the remaining plurality of strips, the next step in the method comprises securing the curtain supporting the structure at the opening with the suspended strips being hung in the opening. Arranging the suspended strips on the supporting structure with each strip being arranged in a pre-selected, overlapping relationship with the adjacent strip or strips whereby the plurality of strips function as an effective thermal barrier. The cut out corners of each strip are defined to have a portion of the strip extending adjacent the loop portion, but terminating a preselected distance below the supporting structure to permit the adjacent overlapping portions to be reversed in position relative to the adjacent strip while still suspended from the supporting structure.

These and other features of the present invention may be more fully appreciated when considered in the light of the following specification and drawings, in which.

Figure 1:
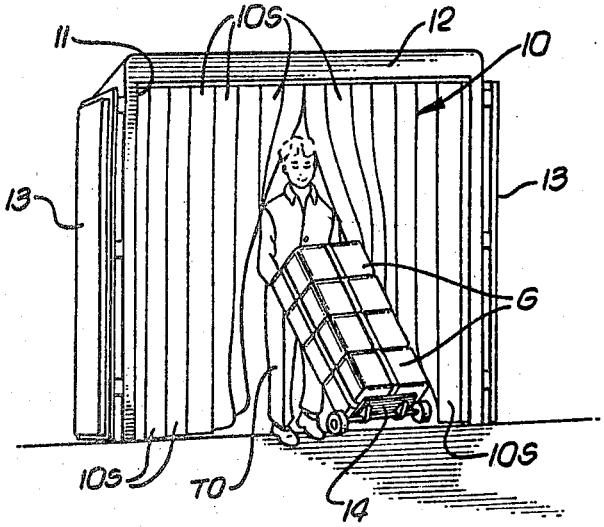
FIG. 1 is a diagrammatic representation of an environmental strip curtain mounted to the rear of the truck through which goods are illustrated as being transported through the parted curtain by means of a hand truck.

Now referring to the drawings, the environmental strip curtain 10 of the present invention will be described in detail. The environmental strip curtain 10 is illustrated in FIG. 1 suspended in the opening 11 of the rear of a truck 12, which may be a refrigerated truck. The doors 13 for the rear opening 11 of the truck 12 are illustrated as conventional hinged doors arranged in an open condition for permitting the truck 12 to be loaded and unloaded. In FIG. 1 the truck operator TO is illustrated as unloading the goods G from the rear of the truck by means of a hand truck 14 at the time when he is passing through the environmental curtain 10.

The strips 10S of the environmental curtain 10 are suspended so that the adjacent strips have their adjacent edges arranged in a preselected overlapping relationship to provide a thermal barrier between the opposite sides of the opening 11. The overlap can be defined in any relationship in accordance with the particular application of the environmental curtain 10. The strips 10S are conventionally constructed of a flexible, transparent plastic material of sufficient weight and thickness to be suspended in a vertical relationship with respect to an opening, such as the opening 11. The strips 10S, however, are easily parted in response to an individual moving the strips apart by hand or by moving an object such as the hand truck 14 therethrough; see FIG. 1. The strips 10S automatically and quickly assume a closed, vertical relationship once the individual or object passes through the environmental curtain 10. The transparent strips 10S permit an individual to readily pass through the curtain 10 as he has the ability to see through the environmental curtain 10 to locate any obstacles or obstructions on the opposite side of the environmental curtain 10 without the need to open a door, such as the doors 13, for this purpose. The action of the curtain strips 10S in opening and closing assures that a minimum amount of energy transfer occurs between opposite sides of a curtained opening.

Figure 2:
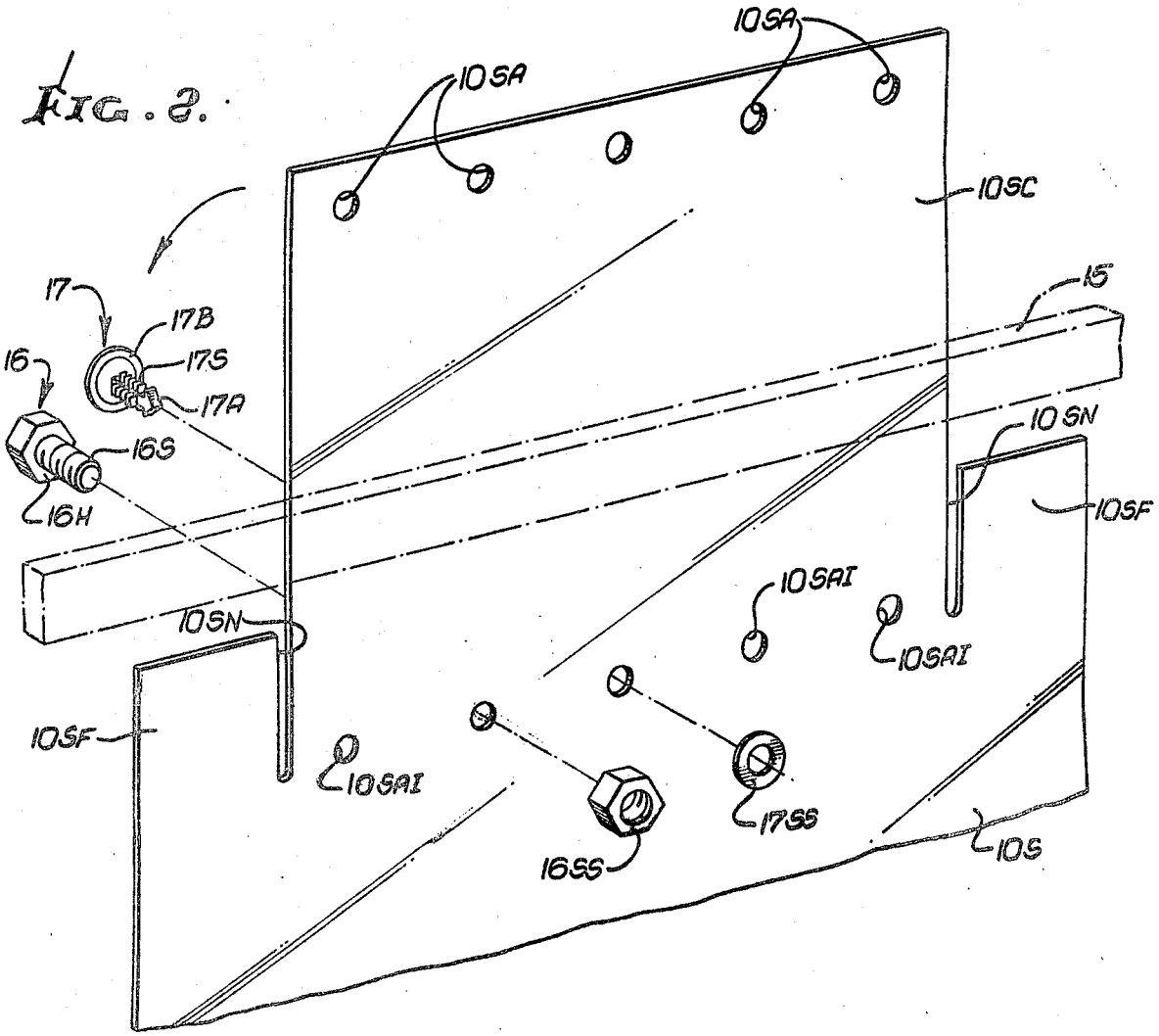
FIG. 2 is an exploded, detached view of the top portion of a strip of the environmental curtain illustrated in FIG. 1 illustrating the relationship of the suspension end of the strip with respect to the suspension means and two different kinds of fastening means therefor.

It will be recognized by those skilled in the art, that the strips 10S are of sufficient length to extend from the top of an opening to the bottom of an opening to provide the necessary thermal barrier between the opposite sides of a curtained opening. In FIG. 2 the top portion of a strip 10S is illustrated in its unlooped condition for the purposes of delineating the improved suspension means disclosed to the art by this application. The top portion of the strip 10S is illustrated with respect to suspension means, shown in the form of a bar 15 which may be secured adjacent to the top of an opening for suspending each of the strips 10S thereon and curtaining the opening. The strip 10S, as illustrated in FIG. 2, has each corner cut out for a pre-selected distance inwardly and downwardly of each corner. The cut outs are defined to provide a substantially central, solid portion 10SC for each strip 10S. The solid portion 10SC is defined to have a sufficient length to allow it to be looped upon itself to define a temporary suspension loop in accordance with the teachings of the present invention. For this purpose, the central portion 10SC is provided with a plurality of fastening apertures 10SA arranged adjacent the top end of the portion 10SC and longitudinaly spaced thereon. The size of the apertures 10SA are generally sized to accept a fastening element for defining a temporary suspension loop, as will be explained immediately hereinafter. A similar row of spaced apertures, wherein each aperture is defined by the reference characters 10SAI, is provided at the inner end of the central portion 10SC. The apertures 10SAI are arranged in vertical alignment with the corresponding apertures in the upper row of the aperture 10SA, as is evident from examining FIG. 2. When the central portion 10SC is looped upon itself, the apertures 10SA are arranged to overlie the apertures 10SAI and by means of suitable fastening means will define a suspension loop.

Figure 5:
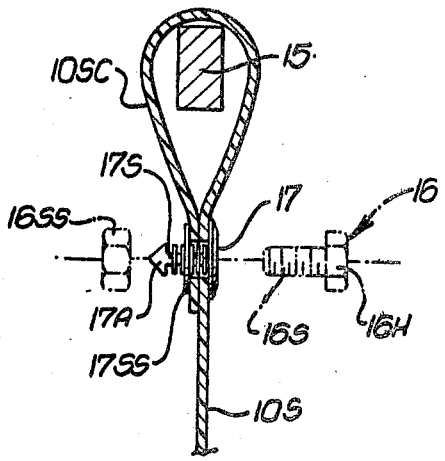
FIG. 5 is a cross-sectional view taken along the line 5—5 of FIG. 3.

The advantage of the temporary suspension loop is that the loop does not have to be defined at the time of manufacturing the strips 10S, but can be readily formed at the time of installation of the environmental curtain 10 for the particular application. The loop is defined at the time of installation by placing the central portion 10SC on one side of the suspension means 15 and looping the section 10SC around and downwardly of the suspension means 15 to cause the apertures 10SA and 10SAI to be in horizontal alignment for defining the temporary suspension loop. The suspension loop is then temporarily secured by means of fasteners, see FIG. 5. Two types of fasteners 16 and 17 are illustrated in FIG. 2. The fastener 16 and the fastener 17 are both plastic fasteners that may be mounted in the apertures 10SA and 10SAI and secured by means of a suitable co-acting securing element such as the corresponding elements 16S and 17S. Each of the fasteners 16 and 17 are constructed of a plastic material that is compatible with the plastic selected for the strips 10S. To this end the fastener 16, which is constructed in the form of a conventional hexagonal head metal nut and bolt is made of a plastic so that when it is secured in the apertures 10SA and 10SAI that it will not tear or cut the strip 10S during the flexing movements of the strip. To this end the fastener 16 includes a hexagonal head 16H with a threaded shank 16S that is threaded from the free end thereof to a pre-selected distance inwardly. The corresponding securing element or nut 16SS having internal threads will be threaded onto the shank 16S to provide the securing means for securing the formed suspension loop.

The other form of fastening element 17 is also constructed of a plastic compatible with the plastic selected for the curtain strips 10S. The fastener 17 comprises a plastic button 17B having an enlarged flat head with an integral shank 17S extending outwardly therefrom. The shank 17S is constructed with a square configuration extending from the head 17B to a point adjacent the opposite end thereof. The square sides of the shank 17S each are provided with a plurality of spaced apart, flexible securing elements extending transverse to the plane of the square sides of the shank 17S. The free end of the shank 17S is defined in the form of an arrowhead 17A for receiving the securing element 17SS. The securing element 17SS is constructed in the form of a thin plastic, flexible fastening element having a central aperture for receiving the free end of the shank 17S and to be releasably fastened thereto when it is positioned over the securing elements of the shank 17S so that it is positioned between the fastening elements and thereby secure the position of the fastener 17. Both types of fastening elements 16 and 17 are of commercially available construction and per se do not form a portion of these applicants' concept. It will be recognized that either form of fastener, or similar fasteners may be utilized in accordance with the concepts of the present invention.

The suspension loop as defined herein above, when mounted to the suspension element 15 is further characterized with a side flap 10SF arranged adjacent the row of apertures 10SAI. When the central portion 10SC is secured in the form of a temporary suspension loop on the suspension means 15, the top end of the flaps 10SF are mounted below the suspension means 15; see FIGS. 3 and 6. The strip 10S is further defined with a notch 10SN that extends from the top of the flap 10SF inwardly of the strip 10S to a point immediately below the row of apertures 10SAI as is evident from examining FIG. 2. The flaps 10SF function to close the opening intermediate the side edges of the strips 10S and the cut out areas below the suspension element 15.

The plastic strips 10S are manufactured by means of conventional extrusion techniques. To this end the strips are extruded under tension which causes the strip to have a camber or slight concavity extending longitudinaly thereof. This concavity is taken advantage of in accordance with the teachings of the present invention to alternate the strips for causing the strips to fit more snugly and give a better sealing action with regard to the transfer of energy in the installation of the environmental curtain 10. This is an important practical advantage when the environmental curtains 10 are installed at locations where they are subjected to the wind. This advantage is offset by the fact that the passage through the curtain 10 is a little more difficult than when the strips are arranged with the concavity facing in the same direction.

Figure 3:
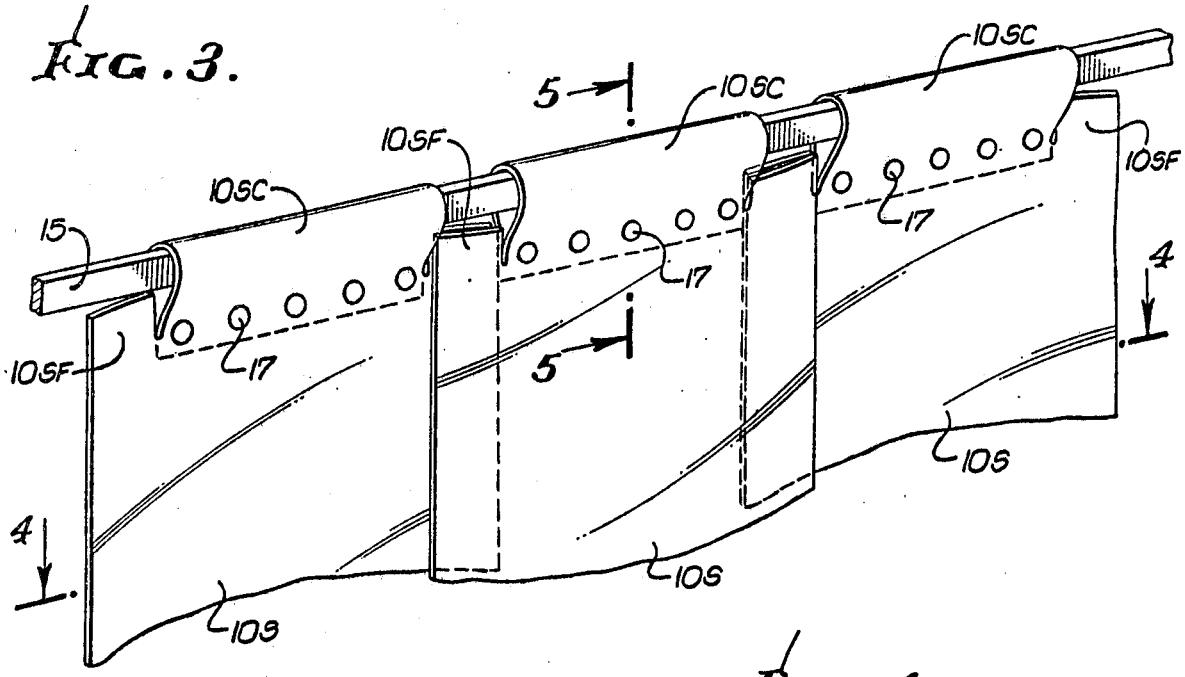
FIG. 3 is a partial, elevational view of the upper end of a series of plastic strips mounted in accordance with the present invention.
Figure 4:
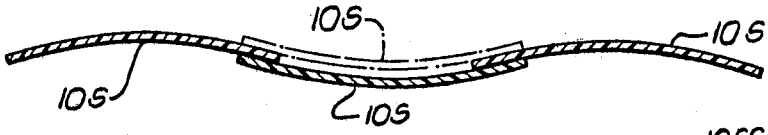
FIG. 4 is a cross-sectional view taken along the line 4—4 of FIG. 3.

The concavity and suspension patterns can be appreciated by examining FIGS. 3 through 7 which illustrate the strips 10S in their suspended condition in two different patterns. In FIG. 3, the strips 10S are secured to the mounting or suspension means 15 with the concavity of the adjacent strips opening in opposite directions, as is readily evident from examining FIG. 4. As illustrated in FIG. 3, strips 10S are not only arranged with the concavity facing opposite directions, but the strips are arranged in a shiplap pattern. As illustrated in FIG. 3, the strips 10S have been mounted on the suspension means 15 by following the above described procedure for defining the temporary suspension loops and are shown with the fasteners 17 secured in position. As is evident from examining the left hand strip 10S, the flaps 10SF for the strip terminates below suspension means 15, see the left hand flap 10SF, for example. In carrying out the installation of the environmental curtain 10, the installer will mount the suspension means 15 loosely to the wall of the opening and then install the strips 10S one at a time on the suspension means. The strips 10S are mounted on the suspension means 15 one at a time by the installer passing the central portion of the strip 10SC behind the suspension means 15 and then over the suspension means to cause the row of apertures 10SA to be aligned and secured together by means of a fastener. The adjacent strips 10S are pushed together so that the overlap or flap portion 10SF of one strip would touch the temporary suspension loop of the next strip, as illustrated in FIG. 3. In installing the strips 10S in this fashion, it should be recognized that this particular type of construction for the strips 10S is advantageous over the permanently sealed loop constructions since a single individual can perform the installation as contrasted with two individuals required for those loops having a permanently sealed construction. In those prior art applications, one individual must hold the suspension means while the other retrieves and slides on the individual sealed loops from the end of the suspension means. The earlier forms of prior art curtains in which the strips are suspended between two bars are even more difficult to install. It should also be appreciated that the fasteners 16 or 17 can be readily applied by a single individual by hand without any tools. The ease of installation can be better appreciated when it is realized that the strips 10S can be very heavy and could be installed as high as twenty feet above the floor requiring the installer to carry out the installation by means of a ladder or scaffolding. Similarly, in replacing a damaged strip 10S, the temporary suspension loop is released, the strip removed from the loosened suspension means and the new strip 10S positioned in lieu of the old strip. This replacement procedure for the prior art types of strips is much more difficult and time-consuming. It should also be recognized that a further advantage of the present invention is that the amount of overlap between the adjacent strips 10S is controlled by the width of the central portion 10SC of the strips 10S.

The fact that the strips 10S are constructed and defined with the side flaps 10SF results in an important practical feature for the curtain 10. Since the top end of the flaps 10SF terminate below the suspension means 15 they can be readily flexed and changed in position by an individual located on the floor level. This allows a reversal of the lap between the shiplap arrangement illustrated in FIGS. 6 and 7 and the standard lap illustrated in FIGS. 3 and 4. While the strips 10S are still suspended, the user of the environmental curtain can grasp a strip 10S and reverse the position of the alternate strips 10S by merely moving a strip to cause the flap 10SF and the associated overlapping portion to be moved to the opposite side of the adjacent strip as is exemplified by the strip illustrated in dotted outline in FIG. 4. This allows the environmental curtain to be either in a shiplap or standard lap configuration at the discretion of the user and in accordance with the environmental conditions in which the curtain is utilized. This is an advantage, for example, when the environmental curtains are exposed to the exterior weather conditions and which weather conditions vary at different times of the year so that at different times of the year the shiplap and the standard lap construction may be desired. If, for example, in conditions where heavy winds blow on the environmental curtain 10, the strips should be arranged in a shiplap arrangement, as illustrated in FIG. 7, so that the concavities will be taken advantage of to provide a tighter sealing action between the adjacent strips 10S. Alternatively, if the environmental curtain 10 is arranged so that the wind is blowing at an angle to the strips 10S so as to cause the wind to pass between the overlapped portions of the strips, it is advantageous to change the overlap of the strips 10S for maximum effectiveness to achieve the standard arrangement of the strips 10S illustrated in FIG. 4.

Figure 6:
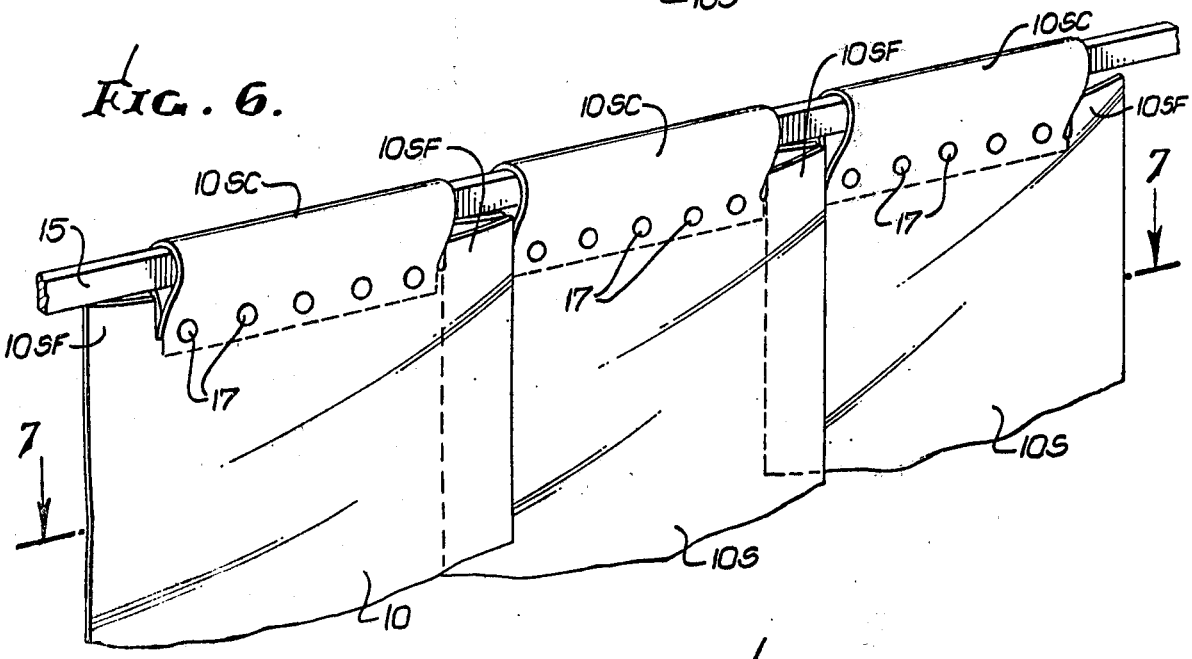
FIG. 6 is a partial, elevational view of the strip curtain arranged in the fashion of the curtain of FIG. 3 but with the successive strips arranged in the same direction.
Figure 7:
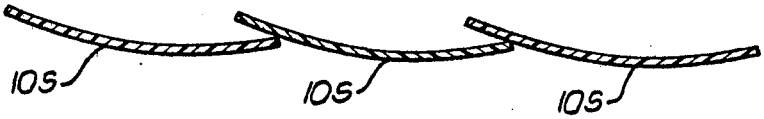
FIG. 7 is a cross-sectional view taken along the line 7—7 of FIG. 6.

FIG. 6 illustrates the strips 10S of FIG. 3 arranged in a standard lap so that the concavities for each of the strips 10S face in the same direction. It should be noted that it is easier to enter the environmental curtain 10 from one direction than the other because of the concave configuration of the strips 10S. In the prior art permanently sealed loops, the arrangement is predetermined at the factory and cannot take into consideration the customer's local conditions and usages in determining the direction of the concavity. It has been determined that on the average the concavity will be in the wrong direction approximately 50% of the time when a permanent suspension loop is provided. In addition to the environmental weather conditions, the desirable pattern of the strips 10S depends upon the flow of traffic in the plant and thereby the strips 10S should be arranged in the direction that permits the easiest entry. With the construction of the strips 10S of the present invention, this can be readily changed while suspended.

Figure 8:
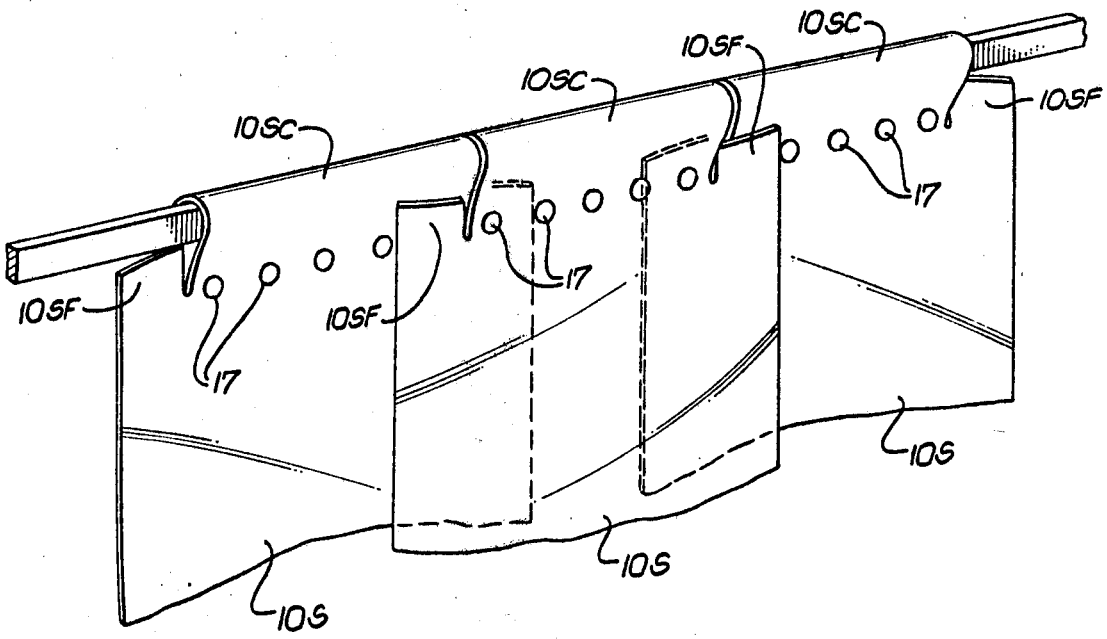
FIG. 8 is a partial, elevational view of the strip curtain with the individual strips arranged with the looped portions arranged in abutting relationship.

In the event a tighter sealing action is desired, the adjacent strips 10S may be arranged on the suspension means so that the edges of the adjacent suspension loops 10SC abut one another, as illustrated in FIG. 8. In this arrangement the flaps 10SF overlap the adjacent looped portions 10SC.

It should now be appreciated by those skilled in the art that the present invention has advanced the state of the art by providing an environmental curtain 10 having improved strips 10S for defining temporary suspension loops wherein the curtain may have its overlapping arrangement readily changed while still in suspension to provide either a shiplap or standard lap arrangement and with the concavities arranged for a preferred sealing action or ease of passage.

What is claimed is:

1. A flexible, transparent strip for use in combination with other transparent strips as an environmental curtain, the strip having a preselected length and a slight longitudinal concavity, the strip being constructed of a flexible, plastic material of sufficient weight and thickness to be suspended in a vertical relationship with an opening it is hung to so as to function as a barrier between the opposite sides of the opening, one end of the strip being constructed and defined with each corner cut out to an extent defining a solid portion substantially centrally of the longitudinal edges of the strip and extending from said one end, said solid portion including a row of spaced apertures arranged adjacent said one end of the strip, the central portion of the strip adjacent the cut out corners being provided with an inner row of spaced apertures with the apertures arranged in vertical alignment with said row adjacent said one end to permit the two rows of apertures to be aligned in overlying relationship when said one end of the strip is looped inwardly of the strip proper to define a suspension loop when secured at the aligned rows of apertures.

2. A flexible, transparent strip for use in combination with other transparent strips as an environmental curtain as defined in claim 1 wherein the cut out corners are constructed and defined with a flap extending on opposite sides of the central portion a preselected distance towards said one end but to have the end of the flap terminate below the lower surface of any supporting structure when the strip is suspended therefrom by means of the above defined loop.

3. A flexible, transparent strip for use in combination with other transparent strips as an environmental curtain as defined in claim 1 or 2 wherein the portion of the strip between the opposite sides of the central portion and the flaps are notched out to render the flaps per se flexibly movable with respect to the strip proper.

4. A flexible, transparent strip for use in combination with other transparent strips as an environmental curtain as defined in claim 1 or 2 including a plurality of plastic fasteners for the row of apertures to secure the central portion to the strip proper to define a suspension loop when the plastic fasteners are secured through the overlying rows of apertures.

5. A flexible, transparent strip for use in combination with other transparent strips as an environmental curtain as defined in claim 4 wherein the plastic fastener comprises a plastic button having an enlarged flat head with an integral shank extending outwardly therefrom, the shank having a square configuration extending from said head to a point adjacent the opposite end thereof with the square sides of the shank each having a plurality of spaced apart, flexible securing elements extending transverse to the plane of the square sides of the shank, and a thin, flat plastic fastening element having a central aperture defined for receiving the free end of the shank and to be releasably fastened thereto by being positioned over the securing elements to position the fastening element between the securing elements spaced around the shank.

6. A flexible, transparent strip for use in combination with other transparent strips as an environmental curtain as defined in claim 4 wherein the plastic fastener comprises a bolt having a head with a threaded shank extending outwardly therefrom, the shank being threaded from the free end of the shank to a preselected distance inwardly thereof, and a threaded nut adapted to be secured to the threaded shank, the nut and bolt being constructed of the same plastic material, the plastic material being selected to be compatible with plastic selected for the transparent strips so as not to damage the strip due to the movement of the strips in use.

7. A flexible, transparent strip for use in combination with other transparent strips as an environmental curtain as defined in claim 1 including means for temporarily securing the loop central portion to the strip proper for defining a strip suspension loop.

8. An environmental curtain comprising a plurality of flexible, transparent strips adapted to be mounted in overlapping relationship in an opening such as a door or the like, the strips when mounted in overlapping relationship functioning as a thermal barrier therebetween opposite sides of the thus enclosed opening, each strip being mountable to a supporting bar or rod extending across the opening, each strip having a loop portion temporarily defined between its longitudinal ends, the strips having one end defined with cut out sections at each corner extending a preselected distance inwardly of the one end, the remaining portion of the plastic strip at said one end being foldable on itself to define a strip supporting loop, the loop being temporarily defined by means of a plurality of plastic fasteners securing the loop portion to the strip proper whereby the strip may be suspended on a bar or rod by the thus defined supporting loop, the cut out sections at each corner terminating a preselected distance below the supporting bar or rod when mounted thereto by means of the thus defined supporting loop, the plastic fastener being further characterized as being readily secured and released including when the strip is suspended on a bar or rod by means of said supporting loop.

9. A flexible, transparent strip for use in combination with other transparent strips as an environmental curtain, the strip having a preselected length and a slight longitudinal concavity, the strip being constructed of a flexible, plastic material of sufficient weight and thickness to be suspended in a vertical relationship with an opening it is hung to so as to function as a thermal barrier for the opposite sides of the opening, one end of the strip being constructed and defined with each corner cut out to an extent defining a solid portion substantially centrally of the longitudinal edges of the strip and extending from said one end, the central portion of the strip adjacent the cut out corners being looped inwardly of the strip proper to define a suspension loop when secured to the strip proper.

10. A flexible, transparent strip for use in combination with the other transparent strips as an environmental curtain as defined in claim 9 including means for securing the loop central portion to the strip proper to define a suspension loop.

11. A flexible strip for use in combination with other flexible strips as an environmental curtain, the strip having a preselected length to extend from the top of an opening to the bottom thereof, the strip being constructed of a flexible material of sufficient weight and thickness to be suspended in a vertical relationship with respect to the opening to function as a thermal barrier for the opposite sides of the opening, one end of the strip being constructed and defined with each corner cut out to an extent to provide a substantial central portion extending from one end that is loopable with respect to the strip proper whereby a strip suspension loop can be provided, the cut out corners of the strips are further defined with a flap extending on opposite sides of the central portion of a preselected distance towards said one end but to have the end of the flap terminate below the lower surface of any supporting structure when the strip is suspended therefrom by means of the strip suspension loop, and means for securing the looped central portion to the strip proper for defining a strip suspension loop.

12. An environmental curtain comprising supporting means mountable to an opening for suspending a plurality of flexible strips in the opening, the strips having a weight and thickness to assume a movable, vertical relationship with respect to the opening to function as a thermal barrier, each strip having the suspension end defined with the corners cut out for defining a loopable section intermediate the corners, the corners each including a flexible flap defined adjacent the loopable section that terminates below the suspension means when the strip is suspended from the supporting means, and means for securing the thus folded, loopable section to the strip proper for permitting the strip to be suspended from the supporting means by the secured loop, the loopable section being mounted on the supporting means with the suspended strips being arranged in a preselected overlapping relationship with respect to the edges of the adjacent strips.

13. An environmental curtain as defined in claim 12 wherein the flexible flaps have vertically extending, narrow, cut out areas adjacent the loopable section extending from the upper ends of the flaps to adjacent the area the loopable section is secured to the strip proper.

14. A method of suspending an environmental curtain including the steps of providing a plurality of flexible, transparent strips adapted to be mounted in an opening to function as the environmental curtain between opposite sides of the opening, cutting out each corner of each strip at one end thereof a preselected distance inwardly of said one end a sufficient distance to permit the remaining central portion of the strip to be folded upon itself to form a supporting loop, securing the looped portion to the strip proper to permit the strips to be suspended from the supporting structure, mounting one of the thus defined strips on a curtain supporting structure for said opening, repeating the latter two steps for each of the remaining plurality of strips, securing a curtain supporting structure at said opening with the suspended strips being hung in said opening, arranging the suspended strips on the supporting structure with each strip being arranged in a preselected overlapping relationship with the adjacent strip or strips whereby the plurality of strips function as an effective environmental curtain, the cut out corners of each strip having a portion of the strip extending adjacent the looped portion but terminating a preselected distance below the supporting structure to permit the overlapping portion to be reversed in position relative to the adjacent strip while still suspended from the supporting structure.

15. A method of suspending an environmental curtain as defined in claim 14 wherein the strips are manufactured with a slightly concave configuration along their longitudinal extent and the step of arranging the suspended strips including arranging the concave side of a strip to face in the opposite direction of the strips at each side for better sealing of the overlapped strips.

16. A method of suspending an environmental curtain as defined in claim 14 wherein the strips are manufactured with a slightly concave configuration along their longitudinal extent and the step of arranging the suspended strips including arranging the concave side of a strip to face in the same direction as the strips at each side thereof to facilitate the passage through the overlapped strips.

17. A method of suspending an environmental curtain as defined in claim 14 including the step of punching a plurality of spaced holes in a row adjacent said one end of the strip at said central portion and punching a corresponding plurality of spaced holes in a row arranged a preselected distance inwardly of said one end so that when the central portion is looped upon itself, the row of holes positioned adjacent said one end of the strip may be aligned with the inner row of holes so that the corresponding holes overlie one another, releasably securing a fastener through the aligned holes in said two rows for securing the looped portion to the strips proper.

18. A method of suspending an environmental curtain as defined in claim 14 wherein the step of arranging the suspended strips on the supporting structure include arranging said portion of the strips adjacent the looped portion to abut the looped portion of the adjacent suspended strip.

19. A method of suspending an environmental curtain as defined in claim 14 wherein the step of arranging the suspended strips on the supporting structure include arranging said looped portions in abutting relationship with the adjacent suspended strips.

* * * * *